United States Patent [19]

Rasmussen

[11] Patent Number: 4,458,579

[45] Date of Patent: Jul. 10, 1984

[54] HYDRAULICALLY DRIVEN RECIPROCATING MOTOR

[76] Inventor: James W. Rasmussen, 2006 Country Club Dr., Midland, Tex. 79701

[21] Appl. No.: 319,964

[22] Filed: Nov. 10, 1981

[51] Int. Cl.[3] ..... F01L 15/12; F01L 21/04

[52] U.S. Cl. ..... 91/224; 91/229; 92/85 A; 92/164

[58] Field of Search ..... 91/229, 224

[56] References Cited

U.S. PATENT DOCUMENTS

| | | | |
|---|---|---|---|
| 245,101 | 8/1881 | Thoyer et al. | 417/401 |
| 852,061 | 4/1907 | Hoffman | 417/53 |
| 906,808 | 12/1908 | Lewis | 91/229 |
| 1,839,611 | 1/1932 | Stafford | 417/401 |
| 2,091,390 | 8/1937 | Forman | 91/224 |
| 2,161,922 | 6/1939 | Goode | 91/229 |
| 2,408,075 | 9/1946 | Kowalski | 91/224 |
| 2,649,078 | 8/1953 | Kelly | 91/229 |
| 2,726,512 | 12/1955 | Deitrickson | 60/372 |
| 2,803,193 | 8/1957 | Salentine | 417/360 |
| 2,838,910 | 6/1958 | Bacchi | 91/291 |
| 2,950,685 | 8/1960 | Salentine | 417/361 |
| 2,990,816 | 7/1961 | Vicent | 91/321 |
| 3,181,470 | 5/1965 | Clingman | 417/56 |
| 3,212,406 | 10/1965 | McDuffie | 91/165 |
| 3,279,326 | 10/1966 | Harvey et al. | 91/229 |
| 3,412,646 | 11/1968 | Johnston | 91/165 |
| 3,782,247 | 1/1974 | Klaeger | 91/306 |

FOREIGN PATENT DOCUMENTS

| | | | |
|---|---|---|---|
| 1269276 | 7/1961 | France | 91/229 |

*Primary Examiner*—Paul E. Maslousky

*Attorney, Agent, or Firm*—Michael A. O'Neil

[57] ABSTRACT

A hydraulically driven reciprocating motor (10) includes a hydraulic cylinder (12) and a piston (60) mounted for reciprocation within the cylinder. The piston has passageways (74) formed therethrough which are normally sealed by a floating valve (90). Rods (76) are carried by the piston (60) and normally project from one end thereof. When the piston (60) reaches the limit of its travel in one direction the rods (76) disengage the floating valve (90), thereby opening the passageways (74) through the piston (60) to permit movement of the piston (60) in the opposite direction. When the piston (60) reaches the limit of its travel in the opposite direction, the floating valve (90) again seals the passageways (74) through the piston (60) to complete the operating cycle of the motor (10).

4 Claims, 6 Drawing Figures

HYDRAULICALLY DRIVEN RECIPROCATING MOTOR

TECHNICAL FIELD

This invention relates to a hydraulically driven reciprocating motor, and more particularly to such apparatus wherein the direction of movement of a piston within a hydraulic cylinder is controlled by apparatus contained within the cylinder.

BACKGROUND AND SUMMARY OF THE INVENTION

In the recovery of oil from subterranean formations it is frequently desirable to utilize some form of artificial lift in order to ensure the movement of oil from the producing formation to the surface at a commercially viable rate. One of the most widely used types of artificial lift apparatus is known as a downhole pump. In a typical downhole pump installation, a standing valve is mounted at the bottom of a tubing string and is provided with a check valve which permits fluid flow into the tubing only. A traveling valve is mounted for reciprocation within the tubing above the standing valve. The traveling valve is also provided with a check valve which permits fluid flow from the portion of the tubing extending between the traveling valve and the standing valve into the portion of the tubing extending above the traveling valve. The traveling valve is connected to the surface by a string of sucker rods. The uppermost sucker rod is in turn connected to the familiar pump jack.

Upon operation of the pump jack, the traveling valve is reciprocated within the tubing string. Reciprocation of the traveling valve causes fluid flow from the bottom of the well first through the standing valve into the portion of the tubing extending between the standing valve and the traveling valve, and then through the traveling valve into the portion of the tubing extending above the traveling valve. The upper portion of the tubing will eventually become filled with well fluid which permits recovery of the fluid at the surface.

The present invention relates to a hydraulically driven reciprocating motor. In accordance with the preferred embodiment of the invention, there is provided a hydraulically driven reciprocating motor which is adapted for use in lieu of a conventional pump jack in operating the traveling valve of a downhole pump. The primary advantage derived from the use of the invention involves the fact that by means thereof a motor for operating the traveling valve of a downhole pump can be manufactured and installed at considerably less cost than is possible when a conventional pump jack is used. Thus, in typical application, cost reductions of up to 75% or more may be realized when a hydraulically driven reciprocating motor incorporating the present invention is used instead of a conventional pump jack to operate the traveling valve of a downhole pump.

More specifically, the present invention comprises a hydraulically driven reciprocating motor including a hydraulic cylinder and a piston mounted for reciprocation within the cylinder. The piston has a passageway formed therethrough which is normally sealed by a floating valve. A rod is carried by the piston and normally projects from one end thereof. When the piston reaches the limit of its travel in one direction the rod disengages the floating valve, thereby opening the passageway through the piston to permit movement of the piston in the opposite direction. When the piston reaches the limit of its travel in the opposite direction the floating valve again seals the passageway through the piston to complete the operating cycle of the motor.

DESCRIPTION OF THE DRAWINGS

A more complete understanding of the invention may be had by reference to the following Detailed Description when taken in conjunction with the accompanying Drawings wherein.

DETAILED DESCRIPTION

Figure 1:
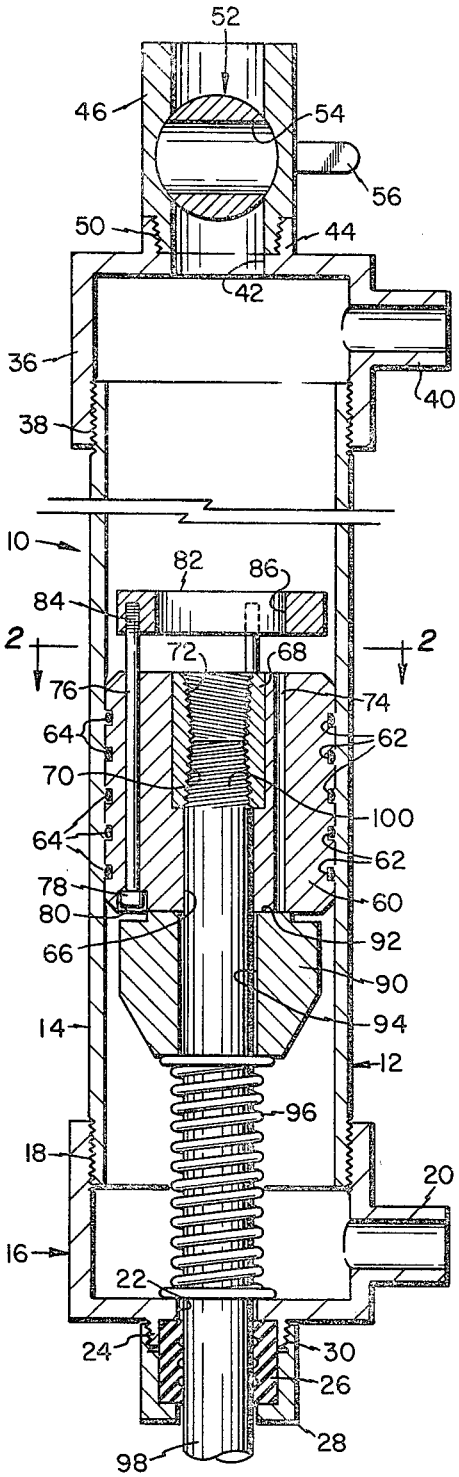
FIG. 1 is a longitudinal sectional view of a hydraulically driven reciprocating motor incorporating the invention.

Referring now to the Drawings, and particularly to FIG. 1 thereof, there is shown a hydraulically driven reciprocating motor 10 incorporating the preferred embodiment of the invention. The motor 10 includes a cylinder 12 comprising a tubular member 14 which is substantially circular in cross section. A lower end cap 16 is secured to the tubular member 14 by means of cooperating threads 18.

The end cap 16 is provided with an inlet port 20 and an end port 22 which is coaxial with the tubular member 14. An extension 24 surrounds the port 22. A packing gland 26 is received within the extension 24 and is retained by the cap 28 which is secured to the extension 24 by means of cooperating threads 30.

An upper end cap 36 is mounted at the upper end of the tubular member 14 and is secured thereto by means of cooperating threads 38. The upper end cap 36 is provided with an outlet port 40 and an end port 42. An extension 44 surrounds the end port 42. A valve block 46 is secured to the extension 44 by means of cooperating threads 50. A ball valve 52 is mounted within the valve block 46 for rotation between the closed position shown and an open position wherein a passageway 54 is axially aligned with the tubular member 14. A handle 56 is provided for selectively pivoting the valve 52 between the closed and opened positions.

A piston 60 is mounted in the hydraulic cylinder 12 for reciprocation within the tubular member 14. The piston 60 is provided with a plurality of circumferential grooves 62. A packing member 64, for example, an O-ring or the like, is mounted within each groove 62 and serves to effect a fluid tight seal between the piston 60 and the tubular member 14. It will thus be understood that the piston 60 is responsive to fluid pressure within the hydraulic cylinder 12 to effect longitudinal movement with respect thereto.

A passageway 66 extends axially through the piston 60. A block 68 is secured in the upper end of the passageway 66 and is provided with opposed sets of conical threads 70 and 72. The threads 70 and 72 are of the type conventionally used in joining adjacent lengths of sucker rod in order to form a connection between the traveling valve of a downhole pump and a pump jack located at the surface.

A plurality of passageways 74 extend through the piston 60. The function of the passageways 74 is to allow fluid flow through the piston 60 during one portion of each operating cycle of the hydraulically driven reciprocating motor 10.

A plurality of rods 76 extend through the piston 60. Each rod 76 has a head 78 which is normally received in a cavity 80. The opposite ends of the rods 76 are secured to a poker plate 82 by means of cooperating threads 84. The poker plate 82 is provided with a passageway 86 centrally disposed therein.

Figure 2:
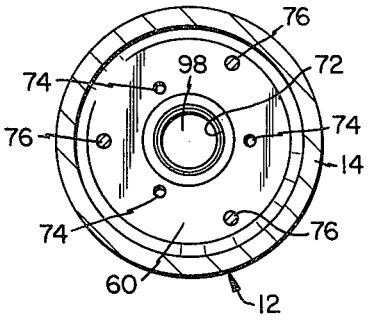
FIG. 2 is a sectional view taken along lines 2—2 in FIG. 1 in the direction of the arrows.

As best shown in FIG. 2, in the preferred embodiment of the invention three passageways 74 are formed through the piston 60. The passageways 74 are located at equally spaced intervals about the axis of the piston 60. Likewise, three rods 76 extend through the piston 60 and are located at equally spaced intervals about the axis thereof. It will be understood that the invention is not limited to any particular number of passageways 74 or rods 76, and that the number thereof may be varied in accordance with particular applications of the invention.

Referring again to FIG. 1, a floating valve 90 is mounted in the hydraulic cylinder 12 beneath the piston 60. When the valve 90 is positioned as shown in FIG. 1 the upper surface 92 thereof seals the passageways 74 and thereby prevents fluid flow through the piston 60. A passageway 94 extends through the center of the floating valve 90 and is axially aligned with the tubular member 14. A compression spring 96 is positioned between the lower end of the floating valve 90 and the interior surface of the lower end cap 16.

A length of sucker rod 98 extends upwardly through the cap 28, the packing gland 26, the end port 22 of the end cap 16, the spring 96, the passageway 94 of the floating valve 90, and the passageway 66 of the piston 60. The sucker rod 98 has a threaded upper end 100 which is threadedly engaged with the threads 70 of the piston 60 so that the sucker rod 98 is secured to the piston 60 for reciprocation therewith.

OPERATION

In the use of the hydraulically driven reciprocating motor 10, the sucker rod 98 is connected to a load requiring reciprocation. Typically, the hydraulically driven reciprocating motor 10 is positioned at the surface above an oil well having a downhole pump installed therein. The sucker rod 98 is connected through a series or string of similar sucker rods to the traveling valve of the downhole pump. The hydraulically driven reciprocating motor 10 is then used in lieu of the conventional pump jack to effect reciprocation of the traveling valve of the downhole pump and thereby pump liquids from the bottom of the oil well to the surface.

Figure 3:
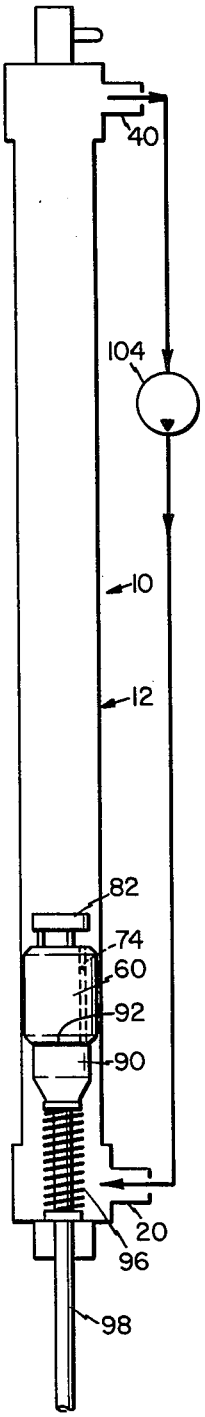
FIGS. 3, 4, 5 and 6 are illustrations of sequential steps in the operating cycle of the hydraulically driven reciprocating motor of FIG. 1.

Referring to FIGS. 3–6, the operating cycle of the hydraulically driven reciprocating motor 10 is shown in detail. Each operating cycle begins with the component parts of the motor 10 positioned as shown in FIG. 3. The floating valve 90 is situated at the bottom of the hydraulic cylinder 12 with the lower end thereof in engagement with the spring 96. The upper surface 92 of the floating valve 90 engages the lower surface of the piston 60 and thereby seals the passageways 74. The poker plate 82 is positioned in a spaced apart relationship with respect to the upper end of the piston 60.

Power for operating the motor 10 is supplied by a hydraulic pump 104 which withdraws hydraulic fluid from the outlet port 40 and supplies pressurized hydraulic fluid to the inlet port 20. Since the passageways 74 are sealed by the floating valve 90, the piston 60 responds to hydraulic fluid pressure supplied by the pump 104 to move upwardly in the hydraulic cylinder 12. This causes upward reciprocation of the sucker rod 98 and the load connected thereto.

Figure 4:
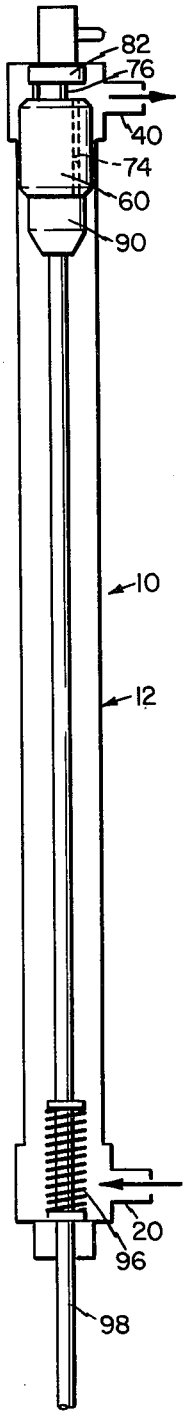
Figure 5:
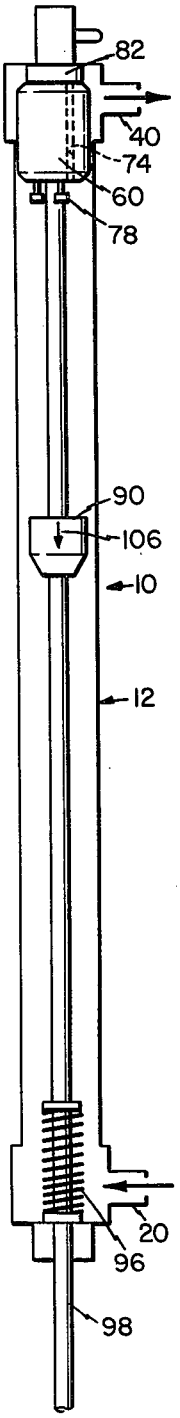
Figure 6:
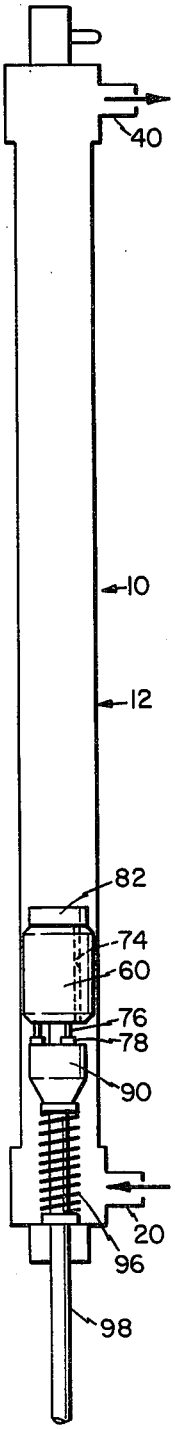

Upward movement of the piston 60 continues until the component parts of the pump 10 are positioned as shown in FIG. 4. At this point the poker plate 82 engages the interior surface of the upper end cap 36 and is thereby prevented from further upward movement. However, the piston 60 continues its upward travel, this action being caused jointly by inertia and by hydraulic pressure supplied by the pump 104. Upward movement of the piston 60 relative to the poker plate 82 closes the gap therebetween, and thereby extends the heads 78 of the rods 76 out of the cavities 80 and into engagement with the floating valve 90. The floating valve 90 is thus disengaged from the piston 60 and thereafter floats downwardly in the hydraulic cylinder 12 under the action of gravity in the manner illustrated in FIG. 5 by the arrow 106.

Disengagement of the floating valve 90 from the piston 60 opens the passageways 76. The combined area of the passageways 76 is sufficient to permit the entire output of the pump 104 to flow therethrough, and also to allow the hydraulic fluid comprising the static volume of the hydraulic cylinder 12 to flow from the rod end of the piston 60 to the blind end thereof. The piston 60, the sucker rod 98 and the load connected thereto therefore begin to reciprocate downwardly in the hydraulic cylinder 12 under the action of gravity. Downward reciprocation continues until the component parts of the pump 10 reach the positions shown in FIG. 5.

The engagement of the piston 60 and the sucker rod 98 with the lower end of the hydraulic cylinder 12 is cushioned by the spring 96. As the heads 78 of the bolts 76 engage the upper surface of the floating valve 90 the poker plate 82 is shifted from the position shown in FIG. 6 wherein it is engaged with the upper surface of the piston 60 to the position shown in FIG. 3 wherein it is spaced apart therefrom. The component parts of the hydraulically driven reciprocating pump are thus returned to their original positions, whereupon another operating cycle of the apparatus is commenced.

Referring again to FIG. 1, the ball valve 52 is utilized only when the pump 104 is not operating and hydraulic pressure has been relieved from the interior of the hydraulic cylinder 12. At such time the handle 56 may be utilized to align the passageway 54 with the axis of the hydraulic cylinder 12. This permits a length of sucker rod to be inserted through the passageway 54 and threadedly engaged with the threads 72 of the piston 60. This permits stroking of the piston 60 in a nonpressurized condition to effect maintenance operations, etc.

Although preferred embodiments of the invention have been illustrated in the accompanying Drawings and described in the foregoing Detailed Description, it will be understood that the invention is not limited to the embodiment disclosed, but is capable of numerous rearrangements, modifications and substitutions of parts and elements without departing from the spirit of the invention.

I claim:

1. A hydraulically driven reciprocating motor comprising:

a vertically oriented hydraulic cylinder;

a piston mounted in the hydraulic cylinder for vertical reciprocation therein and having a passageway extending therethrough;

valve means mounted in the hydraulic cylinder below the piston and responsive to hydraulic pressure therein to form a sealing relationship with the passageway through the piston so that the piston is responsive to hydraulic pressure in a lower end of the hydraulic cylinder to move toward an upper end thereof;

means carried by the piston and responsive to arrival of the piston at said upper end of the hydraulic cylinder for opening the passageway through the piston so that the piston is no longer responsive to hydraulic pressure in said lower end of the hydraulic cylinder and is therefore free to move downwardly away from said upper end of the cylinder and toward said lower end thereof; and a sucker rod extending into the hydraulic cylinder and secured to the piston and responsive to the action of gravity for moving the piston downwardly when the passageway is open;

said valve means comprising a free floating valve member surrounding the sucker rod and adapted for movement in the cylinder independent of the movement of the piston.

2. The hydraulically driven reciprocating motor according to claim 1 wherein the passageway opening means comprises at least one rod slideably supported on the piston and normally extending outwardly from the piston toward said lower end of the hydraulic cylinder.

3. The hydraulically driven reciprocating motor according to claim 2 wherein the free floating valve member is normally held in engagement with the piston by hydraulic pressure within said one end of the hydraulic cylinder, and wherein the means is responsive to engagement with said upper end of the hydraulic cylinder for sliding movement relative to the piston to disengage the floating valve member therefrom.

4. The hydraulic driven reciprocating motor comprising:

a vertically oriented hydraulic cylinder;

a piston mounted in the hydraulic cylinder for vertical reciprocation therein and having a passageway extending therethrough;

a free floating valve member mounted the hydraulic cylinder below the piston and responsive to hydraulic pressure thereto for engagement with the piston to seal the passageway through the piston so that the piston is responsive to hydraulic pressure in a lower end of the hydraulic cylinder to move toward the upper end thereof, said free floating valve member being adapted for movement in the cylinder independent of the movement of the piston;

at least one rod means mounted on the piston for sliding movement with respect thereto and normally projecting from the piston toward the upper end of the hydraulic cylinder and responsive to engagement with said upper end of the hydraulic cylinder for sliding movement relative to the piston to disengage the free floating valve member from the piston to open the passageway through the piston so that the piston is no longer responsive to the hydraulic pressure in said lower end of the hydraulic cylinder and is therefore free to move away from said upper end of the hydraulic cylinder and toward said lower end thereof under the action of gravity;

a spring mounted within the hydraulic cylinder between the free floating valve and said lower end of the hydraulic cylinder;

a sucker rod extending into the cylinder and connected to the piston for reciprocation thereby; and said sucker rod extending through said lower end of the hydraulic cylinder, the spring and the free floating valve member and comprising a substantial mass for moving the piston downwardly under the action of gravity whenever wherever the passageway is open.

* * * * *